US006505452B1

(12) United States Patent
Hannig et al.

(10) Patent No.: US 6,505,452 B1
(45) Date of Patent: Jan. 14, 2003

(54) PANEL AND FASTENING SYSTEM FOR PANELS

(75) Inventors: Hans-Jurgen Hannig, Bergisch Gladbach (DE); Ralf Eisermann, Cochem (DE)

(73) Assignee: Akzenta Paneele + Profile GmbH, Kaisersesch (DE)

( * ) Notice: Subject to any disclaimer, the term of this patent is extended or adjusted under 35 U.S.C. 154(b) by 47 days.

(21) Appl. No.: 09/937,799

(22) PCT Filed: Oct. 9, 2000

(86) PCT No.: PCT/DE99/03257

§ 371 (c)(1),
(2), (4) Date: Sep. 27, 2001

(87) PCT Pub. No.: WO01/02669

PCT Pub. Date: Jan. 11, 2001

(30) Foreign Application Priority Data

Jun. 30, 1999 (DE) ..... 199 29 896
Jul. 2, 2001 (DE) ..... 299 11 462 U

(51) Int. Cl.[7] ..... E04B 2/00

(52) U.S. Cl. ..... 52/582.1; 52/588.1; 52/586.1; 52/589.1; 52/592.1; 52/592.3; 52/592.4

(58) Field of Search ..... 52/582.1, 588.1, 52/586.1, 589.1, 592.1, 592.3, 592.4, 71, 403.1; 403/52, 65, 66, 75, 82, 331

(56) References Cited

U.S. PATENT DOCUMENTS

| | | | |
|---|---|---|---|
| 1,776,188 A | * | 9/1930 | Langbaum |
| 1,854,396 A | | 4/1932 | Davis |
| 2,138,085 A | | 11/1938 | Birtles |
| 2,142,305 A | | 1/1939 | Davis |
| 2,381,469 A | | 8/1945 | Sweet |
| 2,430,200 A | | 11/1947 | Wilson |
| 2,740,167 A | | 4/1956 | Rowley |
| 3,040,388 A | | 6/1962 | Conn |
| 3,172,508 A | | 3/1965 | Doering et al. |
| 3,175,476 A | | 3/1965 | Franks |

(List continued on next page.)

FOREIGN PATENT DOCUMENTS

| | | |
|---|---|---|
| BE | 417526 | 10/1936 |
| BE | 418853 | 1/1937 |
| CA | 991373 B | 6/1976 |
| CH | 200949 | 11/1938 |
| CH | 562377 | 4/1975 |
| DE | 1 963 128 | 6/1967 |
| DE | 2 159 042 | 6/1973 |
| DE | 7402354 | 5/1974 |
| DE | 25 02 992 A1 | 7/1976 |
| DE | 26 16 077 A1 | 10/1977 |

(List continued on next page.)

*Primary Examiner*—Carl D. Friedman
*Assistant Examiner*—Kevin McDermott
(74) *Attorney, Agent, or Firm*—Whiteford Taylor & Preston, LLP; Gregory M. Stone; Jeffrey C. Maynard

(57) ABSTRACT

The invention relates to a fastening system for panels whose edges are provided complementary holding profiles which match one another in such a manner that further panels can be fastened to the free edges of a previously placed panel. The holding profiles of at least the long edges are configured as complementary positive-fit profiles, one of the profiles having a projection with a convex bottom edge, and the other profile having a recess with a concave bottom edge, such that the profiles may be interconnected by a pivoting motion. Such complementary design of the profiles enables the positive-fit profiles of the long edges of two panels to form a common joint which, when the panels are laid, enables bidirectional pivoting of the panels with respect to one another about a pivot axis that is parallel to the joined long edges of the panels.

75 Claims, 10 Drawing Sheets

U.S. PATENT DOCUMENTS

| | | | | |
|---|---|---|---|---|
| 3,192,574 | A | | 7/1965 | Jaffe et al. |
| 3,310,919 | A | | 3/1967 | Bue et al. |
| 3,347,048 | A | * | 10/1967 | Brown |
| 3,526,420 | A | | 9/1970 | Brancaleone |
| 3,657,852 | A | | 4/1972 | Worthington et al. |
| 3,673,751 | A | | 7/1972 | Boassy et al. |
| 3,902,291 | A | | 9/1975 | Zucht |
| 3,988,187 | A | | 10/1976 | Witt et al. |
| 4,094,090 | A | | 6/1978 | Walmer |
| 4,416,097 | A | | 11/1983 | Weir |
| 4,426,820 | A | | 1/1984 | Terbrack et al. |
| 4,599,841 | A | | 7/1986 | Haid |
| 4,741,136 | A | | 5/1988 | Thompson |
| 4,819,532 | A | | 4/1989 | Benuzzi et al. |
| 4,819,932 | A | | 4/1989 | Trotter, Jr. |
| 5,086,599 | A | | 2/1992 | Meyerson |
| 5,283,102 | A | | 2/1994 | Sweet et al. |
| 5,295,341 | A | | 3/1994 | Kajiwara |
| 5,618,602 | A | * | 4/1997 | Nelson |
| 5,630,304 | A | * | 5/1997 | Austin |
| 5,706,621 | A | | 1/1998 | Pervan |
| 5,797,237 | A | * | 8/1998 | Finkell |
| 5,860,267 | A | | 1/1999 | Pervan |
| 6,006,486 | A | * | 12/1999 | Moriau |
| 6,023,907 | A | | 2/2000 | Pervan |
| 6,029,416 | A | * | 2/2000 | Anderson |
| 6,094,882 | A | | 8/2000 | Pervan |
| 6,122,879 | A | * | 9/2000 | Montes |
| 6,182,410 | B1 | | 2/2001 | Pervan |
| 6,209,278 | B1 | * | 4/2001 | Tychsen |
| 6,216,409 | B1 | * | 4/2001 | Roy |

FOREIGN PATENT DOCUMENTS

| | | | |
|---|---|---|---|
| DE | 29 17 025 | A1 | 11/1980 |
| DE | 30 41 781 | A1 | 6/1982 |
| DE | 31 17 605 | A1 | 11/1982 |
| DE | 33 43 604 | A1 | 6/1985 |
| DE | G 90 04 451.7 | | 8/1990 |
| DE | 42 15 273 | A1 | 11/1993 |
| DE | 195 03 948 | A1 | 8/1996 |
| DE | 299 11 462 | U1 | 12/1999 |
| EP | 0 024 360 | A1 | 3/1981 |
| EP | 0 161 233 | B1 | 10/1987 |
| EP | 0 248 127 | A1 | 12/1987 |
| EP | 0 844 963 | B1 | 6/2000 |
| FR | 1.215.852 | | 4/1960 |
| FR | 1.293.043 | | 12/1962 |
| FR | 1.511.292 | | 1/1968 |
| FR | 2.135.372 | | 12/1972 |
| FR | 2 568 295 | A1 | 1/1986 |
| FR | 2 691 491 | A1 | 11/1993 |
| GB | 424057 | | 2/1935 |
| GB | 599793 | | 3/1948 |
| GB | 812671 | | 4/1959 |
| GB | 1127915 | | 9/1968 |
| GB | 1 237 744 | | 6/1971 |
| GB | 1 275 511 | | 5/1972 |
| GB | 1 430 423 | | 3/1976 |
| GB | 2 117 813 | A | 10/1983 |
| GB | 2 256 023 | A | 11/1992 |
| JP | 3169967 | A2 | 7/1991 |
| JP | 04203141 | | 7/1992 |
| JP | 05304714 | | 11/1993 |
| SE | 7114900-9 | | 12/1974 |
| SE | 457 737 | | 1/1989 |
| WO | 84/02155 | A1 | 6/1984 |
| WO | 93/13280 | A1 | 7/1993 |
| WO | 01/02671 | A1 | 1/2001 |

* cited by examiner

PANEL AND FASTENING SYSTEM FOR PANELS

The invention relates to a panel and a fastening system for panels, especially for floor panels, that are placed on a base and whose edges are provided with holding profiles, where the holding profile of a long edge and the holding profile of the opposite edge, as well as the holding profiles of the other two short edges of a panel, match one another in such a manner that further panels can be fastened to the free edges of one of the placed panels, where at least the holding profiles of the long edges of the panels are configured as complementary positive-fit profiles and the panels are interconnected by pivoting them to be joined, that the positive-fit profile of one of the long edges of a panel is provided with a recess and the opposite edge of this panel with a corresponding projection, that the wall of the recess facing the base has an inside cross-section with a concave curvature and that the associated positive-fit profile of the opposite edge of the panel has a projection, the underside of which facing the base has a cross-section with a convex curvature, and that the convex curvature of the projection and the concave curvature of the recess are essentially of complementary design.

Fastening systems of this kind hold installed panels together by means of a positive-fit connection. In the case of floor panels installed in floating fashion on a base, in particular, a positive-fit connection between the panels prevents the formation of gaps, which can form, for example, as the result of thermal expansion or contraction due to a drop in temperature.

German utility model G 79 28 703 U1 describes a generic fastening system. Floor panels with a positive-fit profile of this kind can be connected very easily by means of a pivoting movement. In principle, the connection is also suitable for repeated installation. The resulting positive-fit connection is very stiff and thus very reliably prevents the formation of gaps.

The disadvantage is that the known fastening system is only suitable for very even bases. If the base is uneven, rough and undulating, a panel floor adapts only very poorly to the shape of the uneven base when using the known fastening system. For example, if a panel is held a slight distance above an undulating base by adjacent panels when installed and is then pressed onto the base under load, the interconnected floor panels are deflected. This deflection particularly stresses the joints with the engaged positive-fit profiles. Depending on the load, the interconnected panels bend down or up and are thereby forced out of the normal plane of installation. Due to the great stiffness of the connection, a high load is exerted on the thin cross-sections of the positive-fit profiles, which are thus very quickly damaged. The damage progresses rapidly until a projection or a recess wall ruptures.

Panels can suffer from alternating deflection even on a level base, namely when a soft intermediate layer, such as an impact sound insulation film or the like, is laid on the base. The intermediate layer is compressed at the loaded point and the panels buckle at the joints.

Thus, the object of the invention is to modify the known fastening system such that the stiffness of the connection between two, interconnected positive-fit profiles is adapted to the stress the panels must bear when installed on an uneven base.

According to the invention, the object is solved in that the positive-fit profiles of the long edges of two panels form a common joint when laid, in that the upper side of the projection of a panel facing away from the base displays a bevel extending up to the free end of the projection, in that the bevel increasingly reduces the thickness of the projection towards the free end, and in that the bevel creates space for movement for the common joint.

The new design permits articulated movement of two connected panels. In particular, two connected panels can be bent up-wards at the point of connection. If, for example, one panel lies on a base with an elevation, with the result that one edge of the panel is pressed onto the base when loaded and the opposite edge rises, a second panel fastened to the rising edge is also moved upwards. However, the bending forces acting in this context do not damage the thin cross-sections of the positive-fit profiles. An articulated movement takes place instead.

A floor laid using the proposed fastening system thus displays an elasticity adapted to irregular, rough or undulating bases. The fastening system is thus particularly suitable for panels for renovating uneven floors in old buildings. Of course, it is also more suitable than the known fastening system when laying panels on a soft intermediate layer.

The design caters to the principle of "adapted deformability". This principle is based on the knowledge that very stiff, and thus supposedly stable, points of connection cause high notch stresses and can easily fail as a result. In order to avoid this, components are to be designed in such a way that they display a degree of elasticity that is adapted to the application, or "adapted deformability", and that notch stresses are reduced in this way.

Moreover, the positive-fit profiles are designed in such a way that a load applied to the upper side of the floor panels in laid condition is transmitted from the upper-side wall of the recess of a first panel to the projection of the second panel and from the projection of the second panel into the lower-side wall of the first panel. When laid, the walls of the recess of the first panel are in contact with the upper and lower side of the projection of the second panel. However, the upper wall of the recess is only in contact with the projection of the second panel in a short area on the free end of the upper wall of the recess. In this way, the design permits articulated movement between the panel with the recess and the panel with the projection, with only slight elastic deformation of the walls of the recess. In this way, the stiffness of the connection is optimally adapted to an irregular base which inevitably leads to a bending movement between panels connected to each other.

Another advantage is that panels with the fastening system according to the invention are more suitable for repeated installation than panels with the known fastening system, because the panels with the fastening system according to the invention display no damage to the positive-fit profiles even after long-term use on an uneven base. The positive-fit profiles are dimensionally stable and durable. They can be used for a substantially longer period and re-laid more frequently during their life cycle.

Advantageously, the convex curvature of the projection and the concave curvature of the recess each essentially form a segment of a circle where, in laid condition, the centre of the circle of the segments of the circle is located on the upper side of the projection or below the upper side of the projection. In the latter case, the centre of the circle is located within the cross-section of the projection.

This simple design results in a joint where the convex curvature of the projection is designed similarly to the ball, and the concave curvature of the recess similarly to the sokket, of a ball-and-socket joint, where, of course, in contrast to a ball-and-socket joint, only planar rotary movement is possible and not spherical rotary movement.

In a favourable configuration, the point of the convex curvature of the projection of a panel that protrudes farthest is positioned in such a way that it is located roughly below the top edge of the panel. This results in a relatively thick cross-section of the projection in relation to the overall thickness of the panel. Moreover, the concave curvature of the recess offers a sufficiently large undercut for the convex curvature of the projection, so that they can hardly be moved apart by tensile forces acting in the installation plane.

The articulation properties of two panels connected to each other can be further improved if the inside of the wall of the recess of a panel that faces the base displays a bevel extending up to the free end of the wall and the thickness of this wall becomes increasingly thin towards the free end. In this context, when two panels are laid, the bevel creates space for movement of the common joint. This improvement further reduces the amount of elastic deformation of the walls of the recess when bending the laid panels upwards.

It is also expedient if the recess of a panel for connecting to the projection of a second panel can be expanded by resilient deformation of its lower wall and the resilient deformation of the lower wall occurring during connection is eliminated again when connection of the two panels is complete. As a result, the positive-fit profiles are only elastically deformed for the connection operation and during joint movement, not being subjected to any elastic stress when not loaded.

It is practical if the holding profiles of the short edges of a panel are likewise designed as complementary positive-fit profiles and can be connected to one another by a linear connecting movement.

For the sake of simplicity, the holding profiles of the short edges of a panel are provided with conventional, roughly rectangular tongue-and-groove cross-sections. They are very simple and inexpensive to manufacture and, after connecting the long edges of panel, they can be joined very easily by being laterally slid into one another. The long edges of the panels can also be slid into one another in the parallel direction along their entire length.

In another configuration of the short edge of a panel, the cross-sections of the positive-fit profiles essentially correspond to the cross-sections of the positive-fit profiles of the long edges of the panel. The ability to also connect two panels in articulated fashion on their short edges benefits the flexibility of a floor covering.

The positive-fit profiles preferably form an integral part of the edges of the panels. The panels can be manufactured very easily and with little waste.

The positive-fit profiles according to the invention are particularly suitable if the panels consist essentially of MDF (medium-density fibreboard), HDF (high-density fibreboard) or a particle board material. These materials are easy to process and can be given a sufficient surface quality by means of cutting processes, for example. In addition, these materials display good dimensional stability of the milled profiles.

Another benefit results if the spaces for movement of the common joints are provided with a filler that remains flexible after curing when the panels are installed. This filler preferably seals all joints, particularly the top-side joint, such that no moisture or dirt can enter. During articulated movement of the connected panels, the flexible filler is compressed or expanded, depending on the rotational direction of the articulated movement. In this context, it always adheres to the contact surfaces of the edges of the panels and reverts to its initial shape when the articulated movement is reversed. The filler helps return the joint to its original position due to its elastic, internal deformation.

In an alternative configuration of the fastening system, one short edge of a panel has a first hook element and the opposite short edge of the panel has a hook element that complements the first hook element, the hook elements being provided with holding surfaces that, when assembled, hold the panels together in such a way that the surfaces of the panels abut without gaps at the short edges.

In order to install the panels, the positive-fit profiles on the long edges of the panels must be connected first. To this end, a panel is positioned at an angle and the projection of one long edge is inserted into the recess of the long edge of a laid panel. The common joint is formed in this way. The panel is then held in the angled position and slid in its longitudinal direction until it hits the short edge of an adjacent panel. In this position, the hook elements of the short edges of adjacent panels overlap. If the angled panel is now swung down by means of the joint, the overlapping hook elements engage. They catch behind one another, preventing the panels from being pulled apart in their longitudinal direction. Due to the hook elements, an overlap can be achieved that is roughly equal to one-third of the entire panel thickness. This method for locking the short edges of the panels is similar to the lateral overlap of roofing tiles.

For the sake of simplicity, the first hook element is formed by a web protruding roughly perpendicularly from the short edge and located on the upper side of the panel, where a hook projection facing the lower side of the panel is provided on the free end of the web, and the second hook element is formed by a web protruding from the opposite short edge and located on the lower side of the panel, where a hook projection facing the upper side of the panel is provided on the free end of this web.

The upper side of the panel merges with a reduction in thickness from the area with the thickness of the full panel into the web. The thickness of the web is roughly equal to one-third the panel thickness. The same applies to the lower side of the panel. Opposite the upper-side hook element, the lower-side web merges with a reduction in thickness from the area with the thickness of the full panel into the web, which is again roughly one-third the thickness of the panel.

The webs and the hook projections are thus of relatively solid design. This improves the strength and durability of the fastening system according to the invention.

The hook projection of the lower-side web advantageously contacts the upper-side web of a second panel when a panel is installed. In addition, a space is provided between the hook projection of the upper-side web of the second panel and the lower-side web of the first panel.

Of course, this can also be reversed, so that a space is provided between the hook projection of the lower-side web of the first panel and the upper-side web of the second panel. It is important that one web/hook projection pair of connected hook elements is in definite contact when laid and that the other web/hook projection pair of the same hook elements has a space. If the fastening system were designed such that both web/hook projection pairs were in contact at all times, no definite contact would be achieved due to the tolerances involved in manufacturing the holding profiles, the result being that one web/hook projection pair would sometimes be in contact and sometimes the other.

One configuration of the fastening systems provides that the holding surfaces of the hook projections engage in such a way that they can only be hooked together by means of elastic deformation. This can prevent the hook elements from moving apart under load, for example due to an uneven base. If one panel is loaded, the connected panel moves in the same direction as the loaded panel. The joint stays together.

For the sake of simplicity, the holding surfaces of the hook projections are inclined and the hook projections taper from their free ends towards the webs. In addition, the holding surfaces of complementary hook projections contact one another, at least in some areas. This is a simple design of the hook projections provided with an undercut, because a plane holding surface that is easy to manufacture is provided as the undercut.

Another benefit results if the front side of the upper-side hook projection of one panel at least contacts the second panel in the region of the upper side of the panel when the panels are installed, and if a space is provided between the lower-side hook projection of the second panel and the front side of the first panel. This measure in turn serves to ensure the definite contact of two connected panels at all times by means of the structural design.

On the underside of the panels, which is laid on a base, such as screed, an air gap can be tolerated between the panels in the region of the joint.

An alternative configuration with hook elements on the short edges of the panel is designed such that at least one of the front sides of one of the hook elements of the panels has a protruding snap element on its free end, which engages an undercut recess of the other hook element of the panel. This design has proven to be particularly practical, because the holding profiles can be snapped together by applying slight pressure, thus undergoing elastic deformation. In addition, the holding elements display good wear resistance, which favours multiple installation. The wear resistance is good because the various locking functions are carried out by different areas of the holding element and the load on the holding element is thus distributed. For example, the panels are lokked perpendicular to the installation plane by the snap element and the recess. In contrast, the holding surfaces of the hook projections lock the panels in order to prevent them from being pulled apart in their longitudinal direction.

For the sake of simplicity, the protruding snap element of the first panel is designed as a ridge that extends over the entire length of the edge, and the undercut recess of the second panel is designed as an elongated groove that receives the ridge in the connected position. In order to make the connection, the ridge and the groove must be inserted into one another by elastically deforming the hook elements.

This configuration of the fastening system is suitable for use in cases where no glue is to be used, particularly for multiple installation. In order to take up laid panels, one row of adjacent panels is expediently raised such that they rotate upwards at an angle in the joint. The projections are then pulled out of the recesses at an angle and the joint dismantled. The panels are then only connected at the short edges. It is recommendable to pull apart the joined holding elements of the short edges along their longitudinal extension, in order to avoid material-fatiguing deformation of the hook elements in this way during dismantling.

Another improvement is that the air-filled spaces existing when two panels are installed form glue pockets. In addition to using the proposed fastening system for glueless laying of floor panels, it is also particularly suitable for connection with glue. For this purpose, the points on the holding profiles that must be glued can, for example, be indicated in the instructions or designated by markings on the holding profile itself. In this way, the user can apply glue exactly at the points where glue pockets are formed when two panels are installed.

In most applications of the floor panels, installation with glue is considered to be the most expedient method for laying the panels. This is because it significantly improves the durability of the panels. The gluing of the holding profiles almost completely prevents the ingress of dirt and moisture into the joints. This minimises moisture absorption and the swelling of the panels in the joint region of the holding profiles.

Of course, applications may arise in which glueless installation is preferable. For example, if a floor covering frequently has to be installed, taken up again and re-installed, e.g. for floor coverings on exhibition stands.

The panels are preferably made of a coated substrate material and the holding profiles form an integral part of the edges of the panels. It has become apparent that the strength of modern substrate materials, such as medium-density fibreboard (MDF) or high-density fibreboard (HDF), which are provided with a wear-resistant wear layer, makes them particularly suitable for the use of the proposed fastening system. Even after multiple installation, the holding profiles are still in such good condition that reliable connection is possible even on an uneven base.

BRIEF DESCRIPTION OF THE DRAWINGS

An example of the invention is illustrated in a drawing and described in detail below on the basis of FIGS. 1 to 12. The figures show the following.

DETAILED DESCRIPTION OF THE PREFERRED EMBODIMENTS

Figure 1:
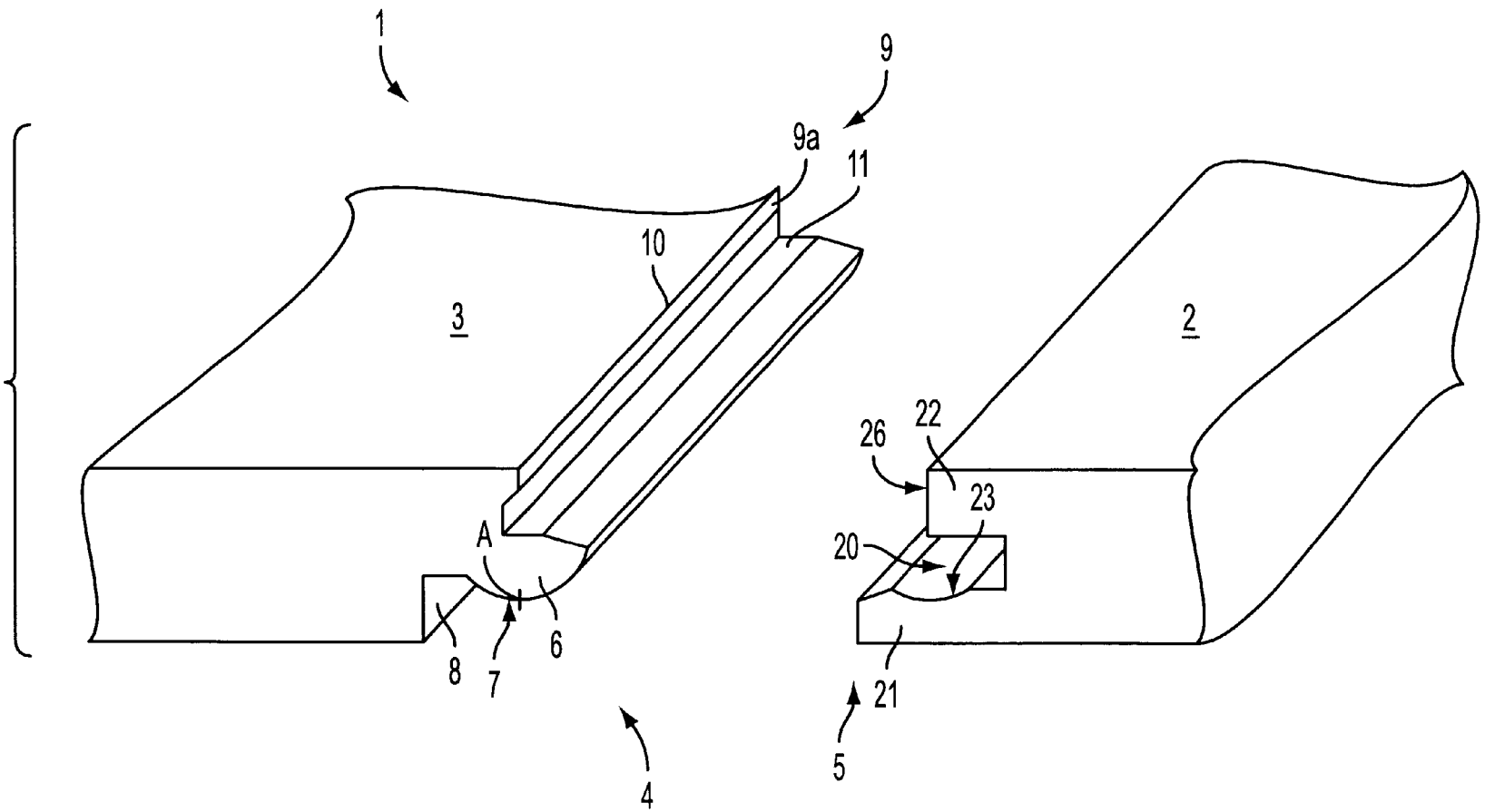
FIG. 1 Part of a fastening system on the basis of the cross-sections of two panels prior to connection, FIG. 2 The fastening system as per FIG. 1 in assembled condition, FIG. 3 A connecting procedure, where the projection of one panel is inserted into the recess of a second panel in the direction of the arrow and the first panel is subsequently locked in place by a pivoting movement, FIG. 4 A further connecting procedure, where the projection of a first panel is slid into the recess of a second panel parallel to the installation plane, FIG. 5 The fastening system in assembled condition as per FIG. 2, where the common joint is moved upwards out of the installation plane and the two panels form a bend, FIG. 6 The fastening system in laid condition as per FIG. 2, where the joint is moved downwards out of the installation plane and the two panels form a bend, FIG. 7 A fastening system in the laid condition of two panels, with a filler material between the positive-fit profiles of the edges, FIG. 8 Special holding profiles for the short edges of a panel in connected condition, FIG. 9 Another configuration of special holding profiles for the short edges of a panel in connected condition, FIG. 10 A schematic diagram of a holding profile with a lower-side web and a drawing of two cutting tools for machining the undercut, FIG. 11 A third configuration of the special holding profiles for the short edges of a panel in connected condition, FIG. 12 A configuration according to FIG. 11, to which an additional snap element has been added.

According to the drawing, fastening system 1 is explained based on oblong, rectangular panels 2 and 3, a section of which is illustrated in FIG. 1. Fastening system 1 displays holding profiles, which are located on the edges of the panels and designed as complementary positive-fit profiles 4 and 5. The opposite positive-fit profiles of a panel are of complementary design in each case. In this way, a further panel 3 can be attached to every previously laid panel 2. Positive-fit profiles 4 and 5 are based on the prior art according to German utility model G 79 28 703 U1, particularly on the positive-fit profiles of the practical example disclosed in FIGS. 14, 15 and 16 and the associated descriptive part of G 79 28 703 U1.

The positive-fit profiles according to the invention are developed in such a way that they permit the articulated and resilient connection of panels.

One of the positive-fit profiles 4 of the present invention is provided with a projection 6 protruding from one edge. For the purpose of articulated connection, the underside of projection 6, which faces the base in laid condition, displays a cross-section with a convex curvature 7. Convex curvature 7 is mounted in rotating fashion in complementary positive-fit profile 5. In the practical example shown, convex curvature 7 is designed as a segment of a circle. Part 8 of the edge of panel 3, which is located below projection 6 and faces the base in laid condition, stands farther back from the free end of projection 6 as part 9 of the edge, which is located above projection 6. In the practical example shown, part 8 of the edge, located below projection 6, recedes roughly twice as far from the free end of projection 6 as part 9 of the edge, located above projection 6. The reason for this is that the segment of a circle of convex curvature 7 is of relatively broad design. As a result, the point of convex curvature 7 of projection 6 that projects farthest (shown at Point A of FIG. 1) is positioned in such a way that it is located roughly below top edge 10 of panel 3.

Part 9 of the edge, located above projection 6, protrudes from the edge on the top side of panel 3, forming abutting joint surface 9*a*. Part 9 of the edge recedes between this abutting joint surface 9*a* and projection 6 of panel 3. This ensures that part 9 of the edge always forms a closed, top-side joint with the complementary edge of a second panel 2.

The upper side of projection 6 opposite convex curvature 7 of projection 6 displays a short, straight section 11 that is likewise positioned parallel to base U in laid condition. From this short section 11 to the free end, the upper side of projection 6 displays a bevel 12, which extends up to the free end of projection 6.

Positive-fit profile 5 of an edge, which is complementary to positive-fit profile 4 described, displays a recess 20. This is essentially bordered by a lower wall 21, which faces base U in laid condition, and an upper wall 22. On the inside of recess 20, lower wall 21 is provided with a concave curvature 23, which has the function of a bearing shell. Concave curvature 23 is likewise designed in the form of a segment of a circle. In order for there to be sufficient space for the relatively broad concave curvature 23 on lower wall 21 of recess 20, lower wall 21 projects farther from the edge of panel 2 than upper wall 22. Concave curvature 23 forms an undercut at the free end of lower wall 21. In finish-laid condition of two panels 2 and 3, this undercut is engaged by projection 6 of associated positive-fit profile 4 of adjacent panel 3. The degree of engagement, meaning the difference between the thickest point of the free end of the lower wall and the thickness of the lower wall at the lowest point of concave curvature 23, is such that a good compromise is obtained between flexible resilience of two panels 2 and 3 and good retention to prevent positive-fit profiles 4 and 5 being pulled apart in the installation plane.

In comparison, the fastening system of the prior art according to FIGS. 14, 15 and 16 of utility model G 79 28 703 U1 displays a considerably greater degree of undercut. This results in extraordinarily stiff points of connection, which cause high notch stresses when subjected to stress on an uneven base U.

According to the practical example, the inner side of upper wall 22 of recess 20 of panel 2 is positioned parallel to base U in laid condition.

On lower wall 21 of recess 20 of panel 2, which faces base U, the inner side of wall 21 has a bevel 24, which extends up to the free end of lower wall 21. As a result, the wall thickness of this wall becomes increasingly thin towards the free end. According to the practical example, bevel 24 follows on from one end of concave curvature 23.

Figure 2:
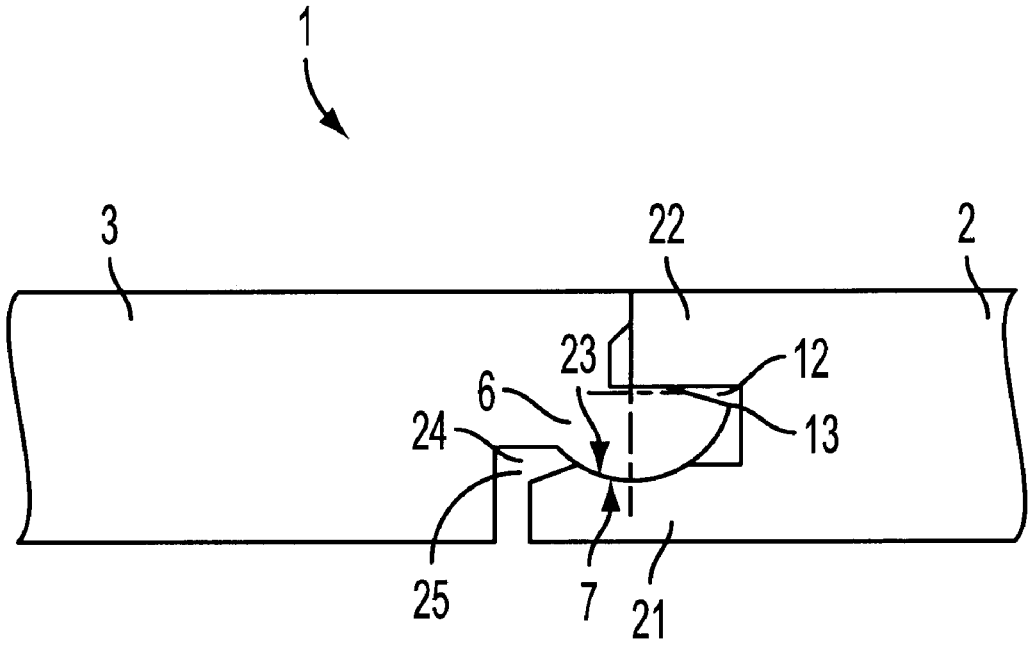

Projection 6 of panel 3 and recess 20 of panel 2 form a common joint G, as illustrated in FIG. 2. When panels 2 and 3 are laid, the previously described bevel 12 on the upper side of projection 6 of panel 3 and bevel 24 of lower wall 21 of recess 20 of panel 2 create spaces for movement 13 and 25, which allow joint G to pivot over a small angular range.

In laid condition, short straight section 11 of the upper side of projection 6 of panel 3 is in contact with the inner side of upper wall 22 of recess 20 of panel 2. Moreover, convex curvature 7 of projection 6 lies against concave curvature 23 of lower wall 21 of recess 20 of panel 2.

Lateral abutting joint surfaces 9*a* and 26 of two connected panels 2 and 3, which face the upper side, are always in definite contact. In practice, simultaneous exact positioning of convex curvature 7 of projection 6 of panel 3 against concave curvature 23 of recess 20 of panel 2 is impossible. Manufacturing tolerances would lead to a situation where either abutting joint surfaces 9*a* and 26 are positioned exactly against each other or projection 6/recess 20 are positioned exactly against each other. In practice, the positive-fit profiles are thus designed in such a way that abutting joint surfaces 9*a* and 26 are always exactly positioned against each other and projection 6/recess 20 cannot be moved far enough into each other to achieve an exact fit. However, as the manufacturing tolerances are in the region of hundredths of a millimetre, projection 6/recess 20 also fit almost exactly.

Figure 3:
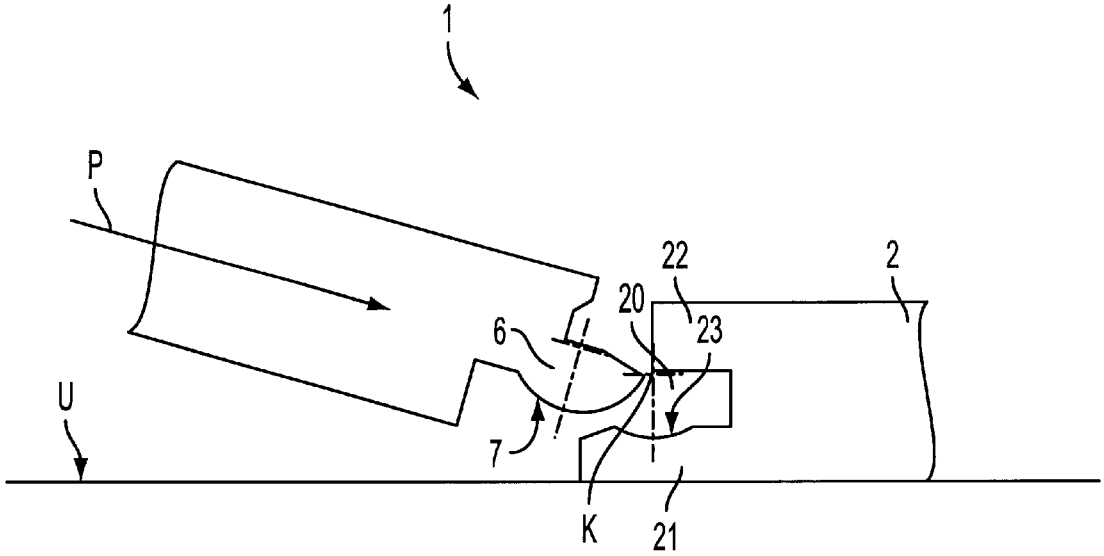

Panels 2 and 3, with described complementary positive-fit profiles 4 and 5, can be fastened to each other in a variety of ways. According to FIG. 3, one panel 2 with a recess 20 has already been laid, while a second panel 3, with a complementary projection 6, is being inserted into recess 20 of first panel 2 at an angle in the direction of arrow P. After this, second panel 3 is pivoted about the common centre of circle K of the segments of a circle of convex curvature 7 of projection 6 and concave curvature 23 of recess 20 until second panel 3 lies on base U.

Figure 4:
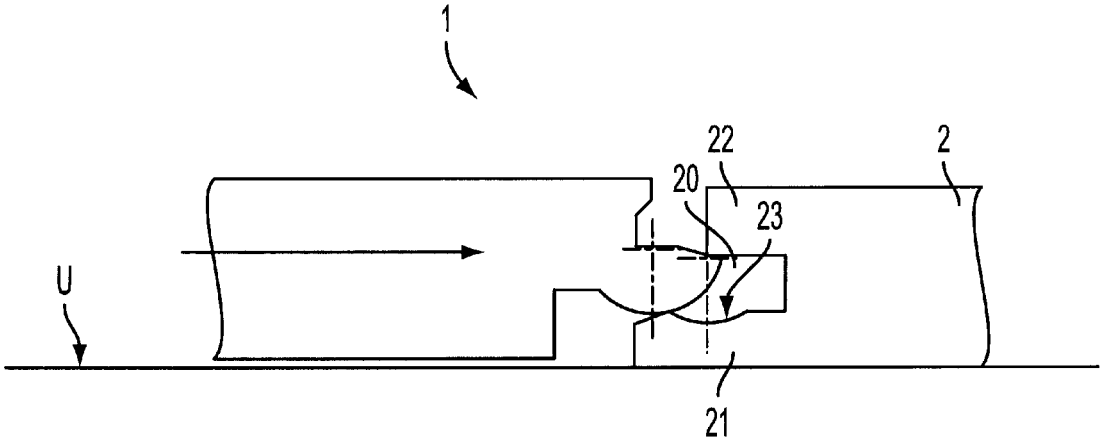

Another way of joining the previously described panels 2 and 3 is illustrated in FIG. 4, according to which first panel 2 with recess 20 has been laid and a second panel 3 with projection 6 is slid in the installation plane and perpendicular to positive-fit profiles 4 and 5 in the direction of arrow P until walls 21 and 22 of recess 20 expand elastically to a small extent and convex curvature 7 of projection 6 has overcome the undercut at the front end of concave curvature 23 of the lower wall and the final laying position is reached.

The latter joining method is preferably used for the short edges of a panel if these are provided with the same complementary positive-fit profiles 4 and 5 as the long edges of the panels.

Figure 5:
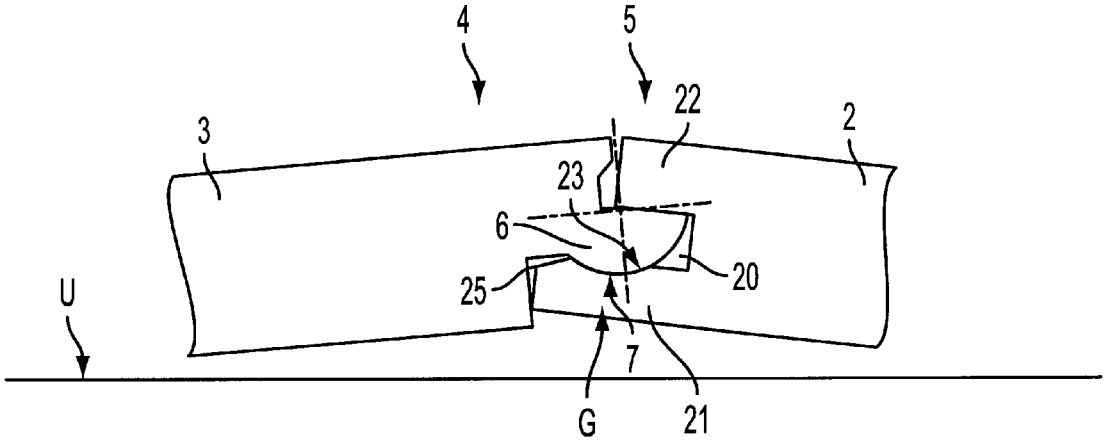

FIG. 5 illustrates fastening system 1 in use. Panels 2 and 3 are laid on an uneven base U. A load has been applied to the upper side of first panel 2 with positive-fit profile 5. The edge of panel 2 with positive-fit profile 5 has been lifted as a result. Positive-fit profile 4 of panel 3, which is connected to positive-fit profile 5, has also been lifted. Joint G results in a bend between the two panels 2 and 3. The spaces for movement 13 and 25 create room for the pivoting movement of the joint. Joint G, formed by the two panels 2 and 3, has been moved slightly upwards out of the installation plane. Space for movement 13 has been utilised to the full for pivoting, meaning that the area of bevel 12 on the upper side of projection 6 of panel 3 is in contact with the inner side of wall 22 of panel 2. The point of connection is inherently flexible and does not impose any unnecessary, material-fatiguing bending loads on the involved positive-fit profiles 4 and 5.

The damage soon occurring in positive-fit profiles according to the prior art, owing to the breaking of the projection or the walls of the positive-fit profiles, is avoided in this way.

Another advantage results in the event of movement of the joint in accordance with FIG. 5. This can be seen in the fact that, upon relief of the load, the two panels drop back into the installation plane under their own weight. Slight elastic deformation of the walls of the recess is also present in this case. This elastic deformation supports the panels in dropping back into the installation plane. Only very slight elastic deformation occurs because the pivot of the joint, which is defined by curvatures 7 and 23 with the form of a segment of a circle, is located within the cross-section of projection 6 of panel 3.

Figure 6:
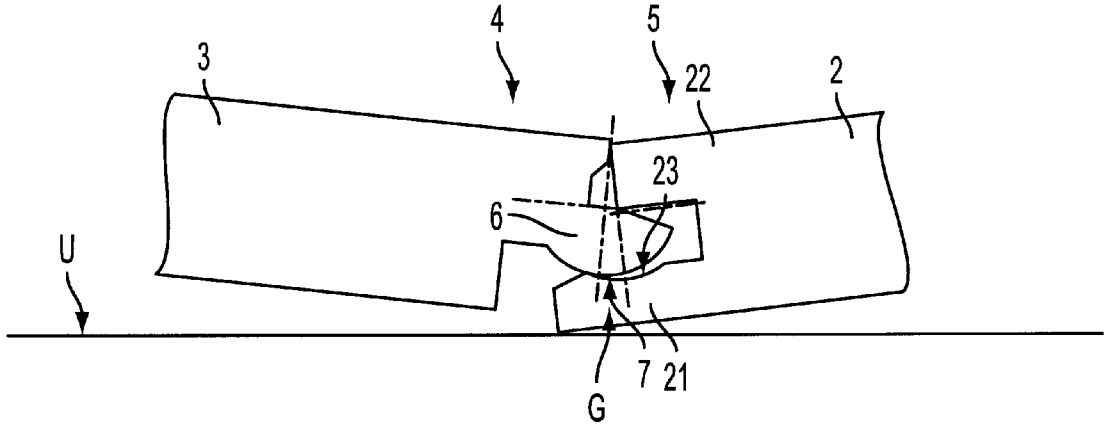

FIG. 6 illustrates articulated movement of two laid panels 2 and 3 in the opposite sense of rotation. Panels 2 and 3, laid on uneven base U, are bent downwards. The design is such that, in the event of downward bending of the point of connection out of the installation plane towards base U, far more pronounced elastic deformation of lower wall 21 of recess 20 occurs than during upward bending out of the installation plane. This measure is necessary because downward-bent panels 2 and 3 cannot return to the installation plane as a result of their own weight when the load is relieved. However, the greater elastic deformation of lower wall 21 of recess 20 generates an elastic force which immediately moves panels 2 and 3 back into the installation plane in the manner of a spring when the load is relieved.

In the present form, the previously described positive-fit profiles 4 and 5 are integrally moulded on the edges of panels 2 and 3. This is preferably achieved by means of a so-called formatting operation, where the shape of positive-fit profiles 4 and 5 is milled into the edges of panels 2 and 3 in a single pass by a number of milling tools connected in series. Panels 2 and 3 of the practical example described essentially consist of MDF board with a thickness of 8 mm. The MDF board has a wear-resistant and decorative coating on the upper side. A so-called counteracting layer is applied to the underside in order to compensate for the internal stresses caused by the coating on the upper side.

Figure 7:
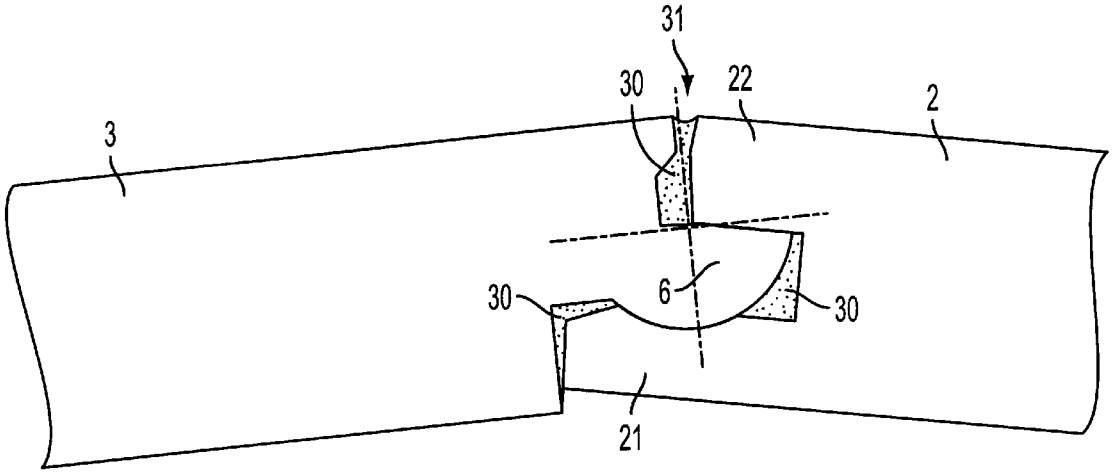

Finally, FIG. 7 shows two panels 2 and 3 in laid condition, where fastening system 1 is used with a filler 30 that remains flexible after curing. Filler 30 is provided between all adjacent parts of the positively connected edges. In particular, top-side joint 31 is sealed with the filler to prevent the ingress of any moisture or dirt. In addition, the elasticity of filler 30, which is itself deformed when two panels 2 and 3 are bent, brings about the return of panels 2 and 3 to the installation plane.

Figure 8:
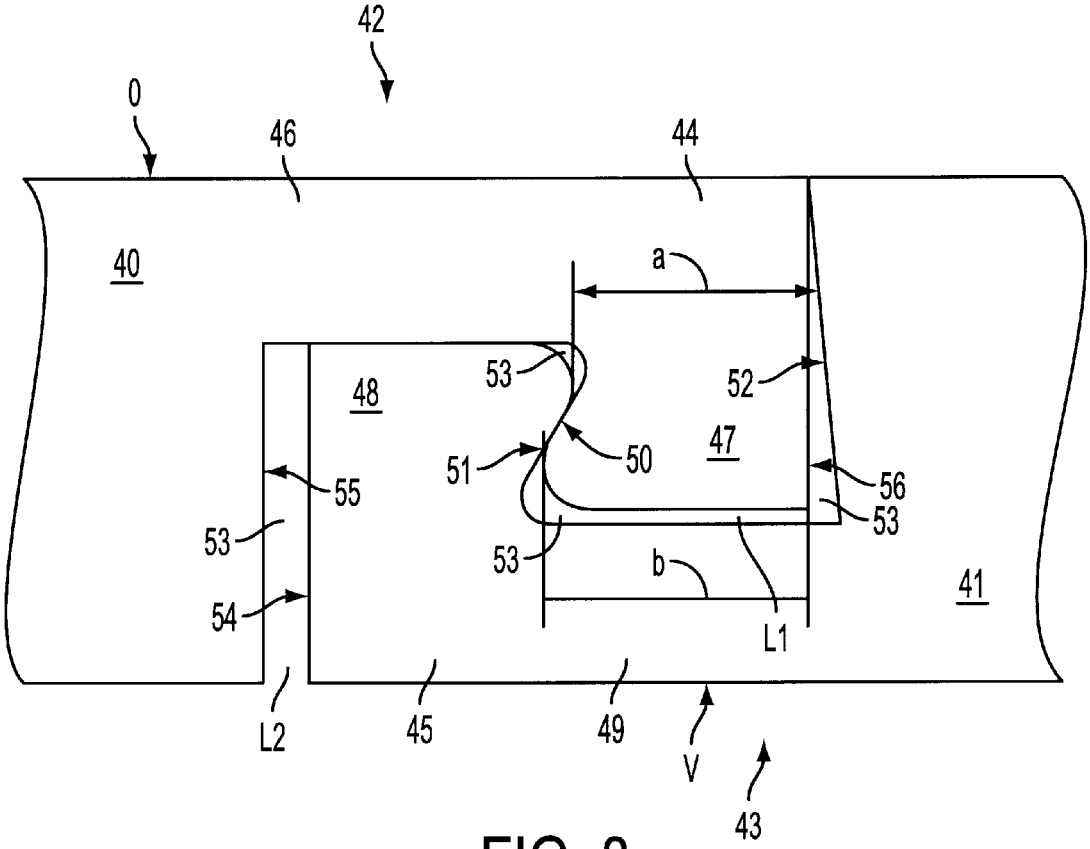

FIG. 8 shows special holding profiles, which are provided for the short edges of panels 40 and 41. The opposite, short sides of each panel have matching holding profiles 42 and 43 with complementary hook elements 44 and 45. In this way, a right-hand holding profile 42 of a first panel 40 can always be connected to a left-hand holding profile 43 of a second panel 41. FIG. 8 shows the short edges of panels 40 and 41 in connected position. Hook element 44 is formed by a web 46, which protrudes roughly perpendicularly from the short edge and is located on the upper side of the panel O. In this context, the free end of web 46 is provided with a hook projection 47 facing the underside V of panels 40 and 41. Hook projection 47 is engaged in a hook projection 48 of second panel 41. Hook element 45 of second panel 41 is formed by a web 49, which protrudes from the edge of second panel 41 and is located on the underside V of second panel 41. Hook projection 48 is located on the free end of web 49 and faces the upper side O of panel 40. Hook projections 47 and 48 of the two panels 40 and 41 are hooked into one another.

When the second panel 41 is installed, hook projection 48 of second panel 41 with lower-side web 49 contacts upper-side web 46 of first panel 40. For the purpose of definite contact, a space L1 is provided in the present configuration between hook projection 47 of upper-side web 46 of first panel 40 and lower-side web 49 of second panel 41.

According to FIG. 8, holding surfaces 50 and 51 of hook projections 47 and 48 engage one another in such a way that hook projections 47 and 48 can only hook into one another by elastic deformation. An opening, which is formed between inside surface 52 of holding profile 43 of second panel 41 and the opposite holding surface 50 of hook projection 48, has a width a at its narrowest point. This width is less than width b of hook projection 47 of first panel 40 at its widest point. Due to this design, and due to the elastic deformation during connection of hook projections 47 and 48, complementary hook projections 47 and 48 snap together into a defined end position. In the present configuration, holding surfaces 50 and 51 of hook projections 47 and 48 are of simple form and designed as angled, plane surfaces. Hook projections 47 and 48 taper from the free ends towards webs 46 and 49. In the present practical example, holding surface 51 of hook projection 47 of first panel 40 is rounded on the upper and lower end, as shown in FIG. 8. The same applies to holding surface 50 of hook projection 48 of second panel 41. This facilitates the insertion of hook projections 47 and 48, in that hook profiles 42 and 43 are slowly expanded in elastic fashion during a connecting movement that is perpendicular to the plane of installation. This facilitates installation and spares holding profiles 42 and 43.

Abutting holding surfaces 50 and 51 of interacting panels 40 and 41 thus press against one another in certain areas. The resulting spaces can advantageously serve as glue pockets 53. Furthermore, a space L2 is provided between front side 54 of lower-side hook projection 48 of second panel 41 and inside surface 55 of first panel 40. The resulting intermediate space can likewise serve as glue pocket 53. The same applies to front side 56 of upper-side hook projection 47 of first panel 40, which, when assembled, contacts second panel 41 at least in the region of the upper side of the panel O. In the present practical example, an intermediate space, which is likewise designed as a glue pocket 53, expands from below upper side of the panel O towards the inside of the connection.

Figure 9:
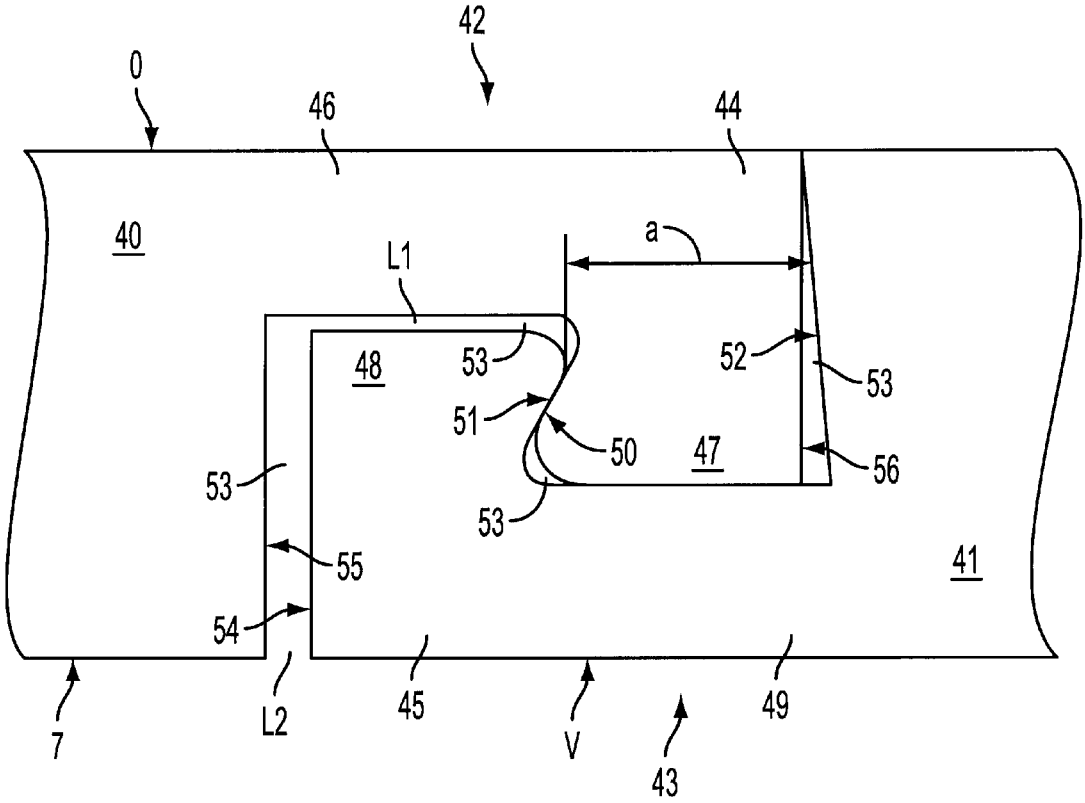

A second configuration of a fastening system is illustrated in FIG. 9. It shows the same technical features with the same reference numbers as in FIG. 8. The configuration according to FIG. 9 differs from the practical example in FIG. 8 in that, of the two pairs of web 49/hook projection 47 and web 46/hook projection 48, the pair in contact and the pair with a space L1 are reversed. The basic function of the fastening system remains the same. Hook projection 47 is again in definite contact and the surface of the floor covering has no gaps.

Figure 10:
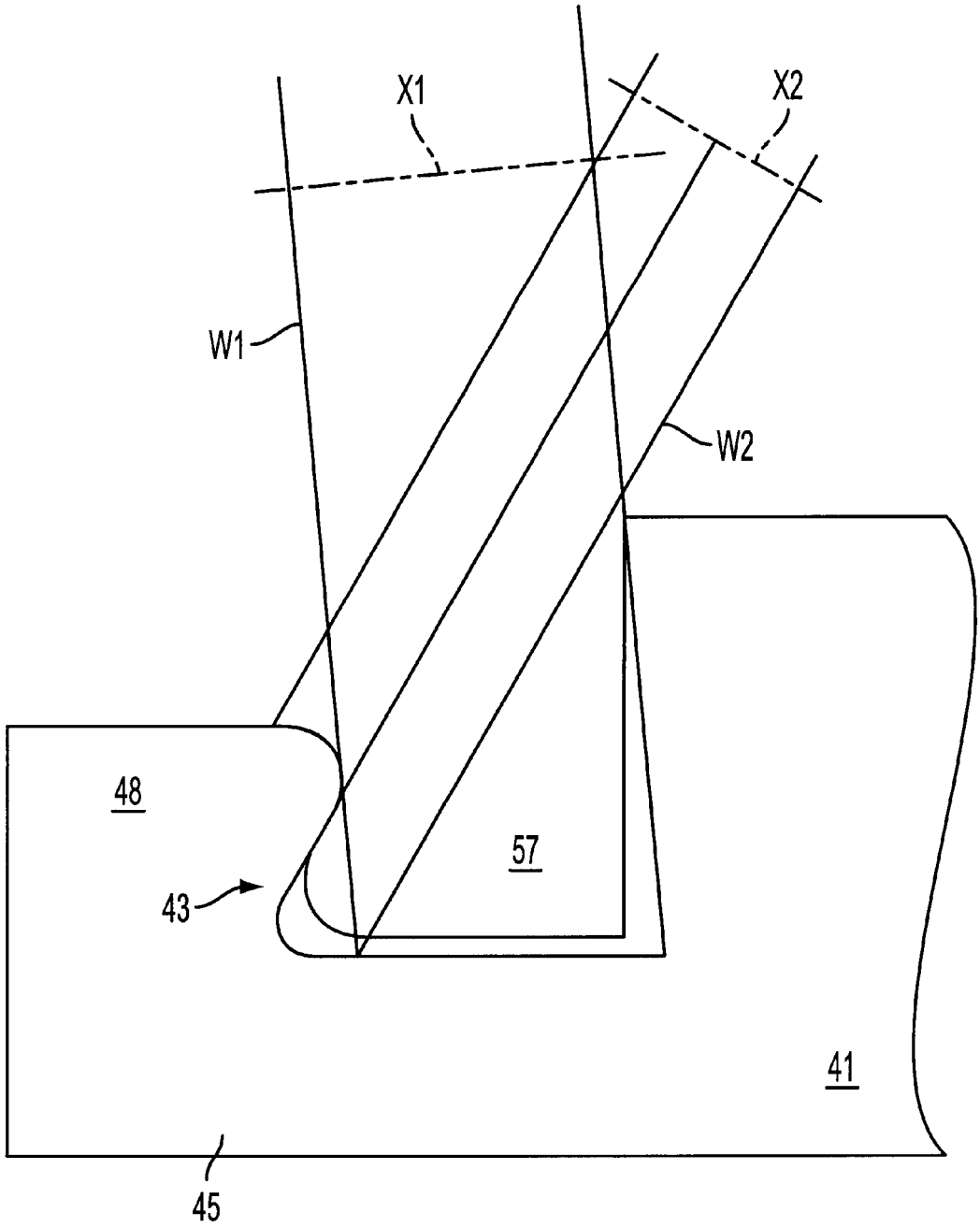

FIG. 10 shows a schematic diagram of a panel 41 with a holding profile 43 according to the invention. It shows schematically how the undercut contour of hook projection 48 can be manufactured with the help of two cutting tools W1 and W2, which rotate about axes X1 and X2. Tools W1 and W2 create recess 57, into which a complementary hook projection of another panel (not shown) can be snapped.

Figure 11:
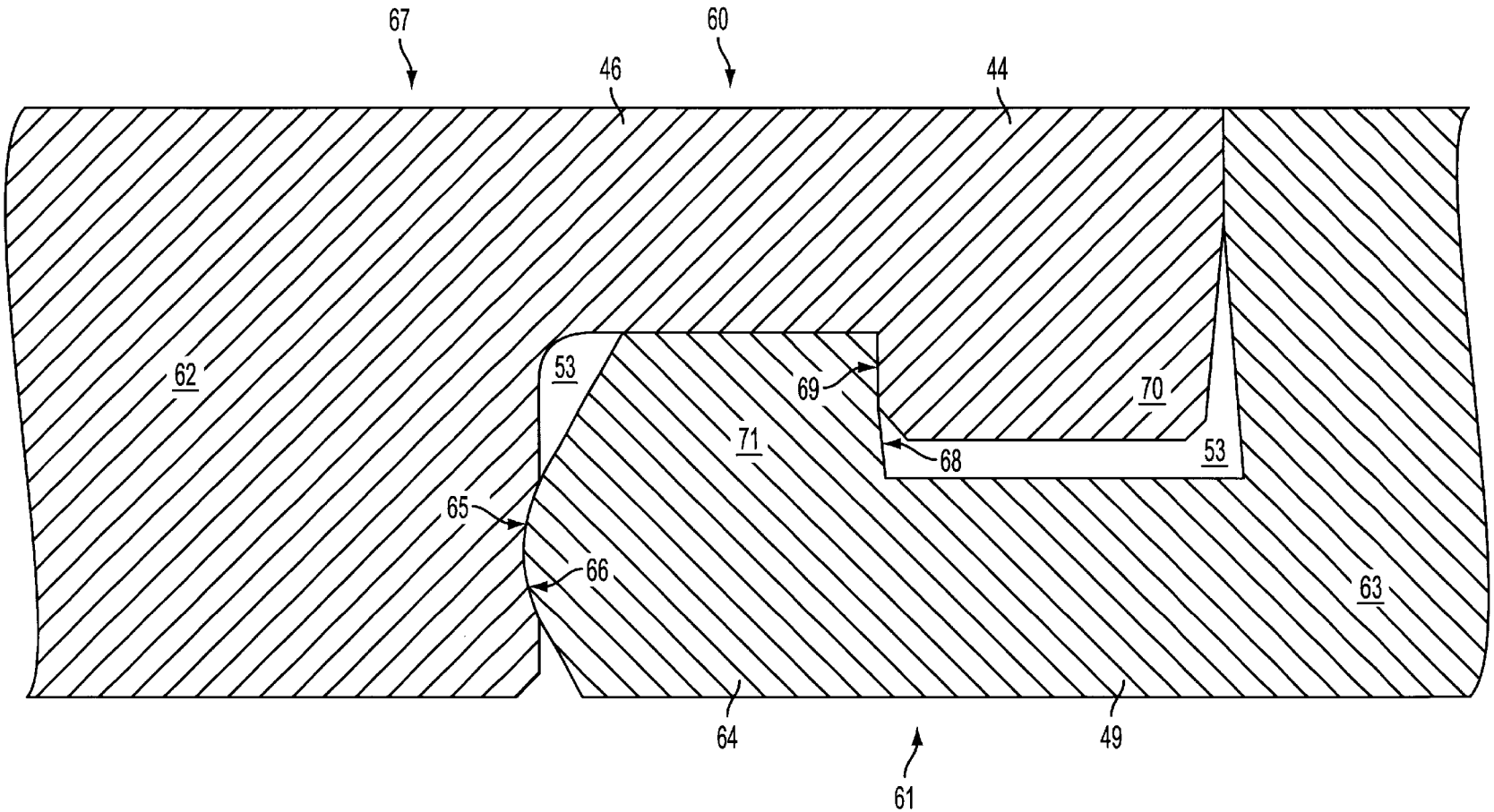

Finally, FIG. 11 shows an alternative configuration with special complementary holding profiles 60 and 61 on the short edges of panels 62 and 63. Hook elements 64 and 67 are again provided, which have webs and hook projections as in the configurations above. The configuration according to FIG. 11 is designed such that front side 75 of lower-side hook element 64 of second panel 63 has a protruding snap element 65 on its free end, which engages an undercut recess 66 of upper-side hook element 67 of first panel 62. Hook elements 64 and 67 can be snapped together by applying slight pressure and undergoing elastic deformation. Panels 62 and 63 are locked perpendicular to the installation plane by snap element 65 that engages recess 66. The locking of panels 62 and 63 to prevent them from being pulled apart in their longitudinal direction is achieved by holding surfaces 68 and 69, which are provided on hook projections 70 and 71 of hook elements 64 and 67.

In the configuration shown, protruding snap element 65 of second panel 63 is designed as a ridge that extends over the entire length of the edge. Undercut recess 66 of first panel 62 is designed as an elongated groove, which receives the ridge in the connected position. The ridge and the groove can be milled in a single manufacturing step by a process known as formatting. In order to connect panels 62 and 63, the ridge and the groove must be inserted into one another by elastically deforming hook elements 64 and 67.

Figure 12:
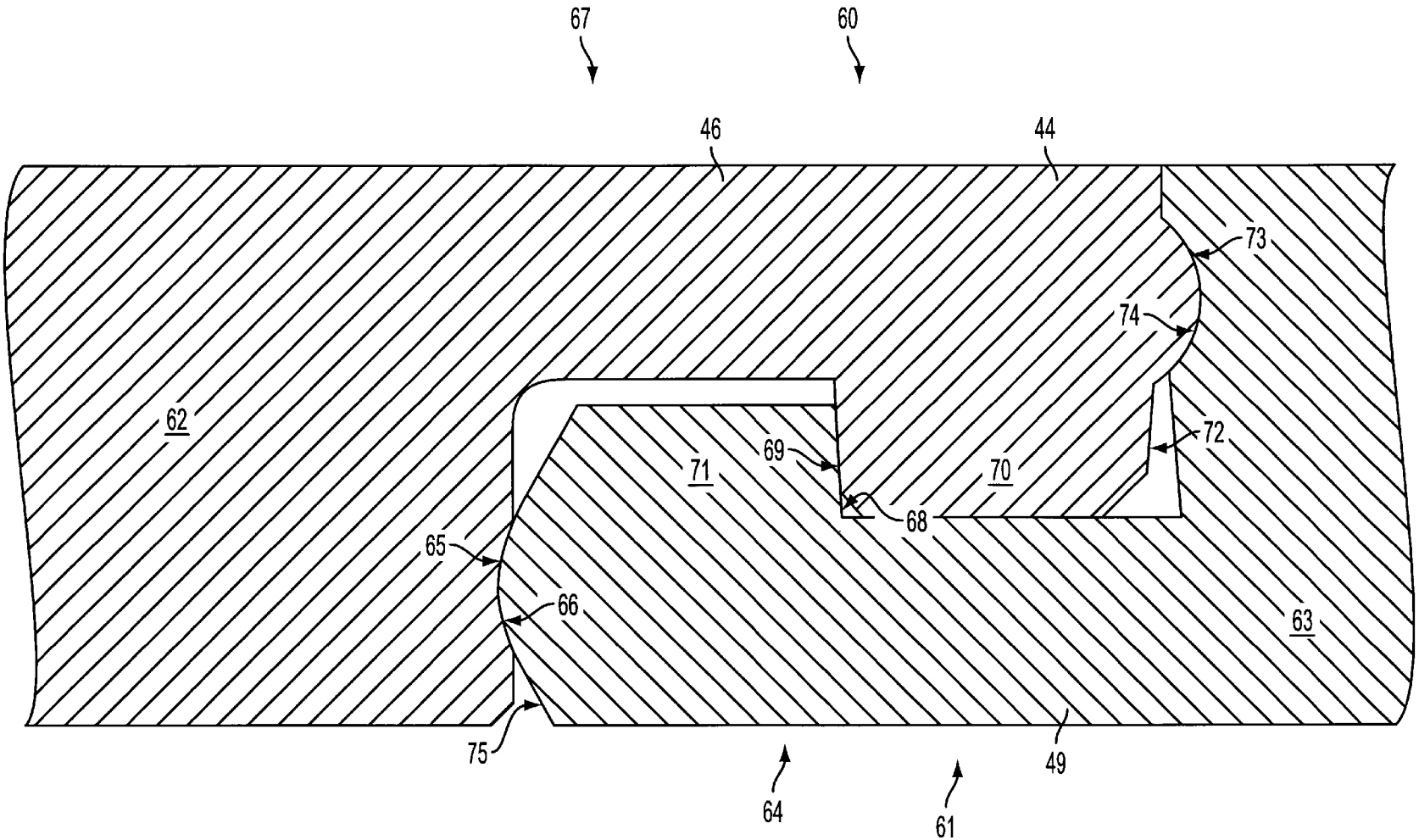

FIG. 12 shows another configuration, which is based on the configuration in FIG. 11. In this context, the same features in the two figures are designated by the same reference numbers. Compared to the configuration in FIG. 11, the configuration according to FIG. 12 is designed such that front side 72 of upper-side hook element 67 of first panel 62 also has a protruding snap element 73 on its free end, which engages an undercut recess 74 of lower-side hook element 64 of second panel 63. In order for hook elements 67 and 64 to snap together, somewhat greater pressure must be exerted than in the practical example according to FIG. 11. Panels 62 and 63 are locked together more firmly than in the configuration according to FIG. 11 due to snap element 65 engaging recess 66 and the additional snap element 73 engaging recess 74. Protruding snap elements 65 and 73 of panels 62 and 63, respectively, are designed as ridges that extend over the entire length of an edge. Of course, the ridge on a hook projection 64 or 67 can also be replaced, for example, by a protruding nose with a bevel (not shown), where the bevel of the nose is oriented such that the corresponding hook element is gently expanded as the connection procedure progresses. Undercut recesses 66 and 74 of panels 62 and 63 are designed as elongated grooves, which receive the ridges in the connected position. The ridges and the grooves can be milled in a single manufacturing step by a process known as formatting. In order to connect panels 62 and 63, the ridge and the groove must be inserted into one another by elastically deforming hook elements 67 and 64. The practical examples in FIGS. 11 and 12 also differ in reference to the interaction of webs 46, 49 with hook projections 71, 70. According to FIG. 11, web 46 contacts hook projection 71 and a space is provided between hook projection 70 and web 49. According to FIG. 12, a space is provided between web 46 and hook projection 71 and hook projection 70 contacts web 49.

LIST OF REFERENCE NUMBERS

1 Fastening system
2 Panel
3 Panel
4 Positive-fit profile
5 Positive-fit profile
6 Projection
7 Convex curvature
8 Part of the edge
9 Part of the edge
**9*a*** Abutting joint surface
10 Top edge
11 Section
12 Bevel
13 Space for movement
20 Recess
21 Lower wall
22 Upper wall
23 Concave curvature
24 Bevel
25 Space for movement
26 Abutting joint surface
30 Filler
31 Top-side joint
40 Panel
41 Panel
42 Holding profile
43 Holding profile
44 Hook element
45 Hook element
46 Web
47 Hook projection
48 Hook projection
49 Web
50 Holding surface
51 Holding surface
52 Inside surface
53 Glue pocket
54 Front side
55 Inside surface
56 Front side
57 Recess
60 Holding profile
61 Holding profile
62 Panel
63 Panel
64 Hook element
65 Snap element
66 Recess
67 Hook element
68 Holding surface
69 Holding surface
70 Hook projection
71 Hook projection
72 Front side
73 Snap element
74 Recess
75 Front side
G Joint
K Centre of circle O Upper side of the panel
P Arrow
U Base
V Underside

What is claimed is:

1. Fastening system for panels that are placed on a base, the system comprising:

holding profiles provided on at least a first pair of opposite edges of a panel, which profiles match one another in such a manner that further panels can be fastened to the edges of the panel, the holding profiles being complementary positive-fit profiles allowing the panels to be interconnected by pivoting, the positive-fit profiles forming elements of a common joint when two panels are laid, said elements allowing bidirectional rotation of adjacent, joined panels from a coplanar position.

2. Fastening system according to claim 1, wherein the holding profiles comprise a joint projection provided on one edge of the first pair of opposite edges of the panel, and a joint recess provided on another edge of the first pair of opposite edges of the panel, which joint recess is complementary to the joint projection, and wherein the joint projection is provided with a convex curvature, and the joint recess is provided with a concave curvature, which concave curvature is complementary to the convex curvature of the joint projection.

3. Fastening system according to claim 2, wherein a point of the convex curvature of the projection that protrudes farthest from an upper face of the panel is located approximately below a top edge of the panel.

4. Fastening system according to claim 2, wherein an inner side of a lower wall of the joint recess has a bevel, which extends up to a free end of the lower wall, such that the thickness of the lower wall decreases towards the free end, wherein the bevel creates space for bidirectional movement of adjacent panels at the common joint when two panels are laid.

5. Fastening system according to claim 2, wherein the joint recess of a panel can be expanded for connection with the joint projection of an adjacent panel by resilient deformation of a lower wall of the joint recess, which resilient deformation of the lower wall occurring during connection is eliminated when connection of the two panels is complete.

6. Fastening system according to claim 1, wherein holding profiles of a second pair of opposite edges of the panel are positive-fit profiles that can be fastened to corresponding profiles of another panel by means of a linear connecting movement.

7. Fastening system according to claim 6, wherein the holding profiles of one of the second pair of opposite edges of the panel is provided with an approximately rectangularly grooved cross-section and the other one of the second pair of opposite edges of the panel is provided with an approximately rectangularly tongued cross-section.

8. Fastening system according to claim 6, wherein the retaining profiles of the second pair of opposite edges of the panel correspond to the retaining profiles of the first pair of opposite edges of the panel.

9. Fastening system according to claim 1, wherein the retaining profiles form an integral part of the opposite edges of the panels.

10. Fastening system according to claim 1, wherein spaces for bidirectional rotation of adjacent joined panels from a coplanar position are provided with a filler that remains flexible after curing.

11. Fastening system according to claim 1, further comprising a second pair of opposite edges, wherein one edge of a panel has a first hook element and the opposite edge of the second pair of opposite edges of the panel has a second hook element that complements the first hook element, and the hook elements are provided with holding surfaces that, when assembled, hold the panels together in such a way that the surfaces of the panels abut without gaps at the second pair of opposite edges.

12. Fastening system according to claim 11, wherein the first hook element is formed by a first web protruding approximately perpendicularly from one of the second pair of opposite edges and located on an upper side of the panel, where a first hook projection facing an underside of the panels is provided on a free end of the first web, and that the second hook element is formed by a second web protruding from the other one of the second pair of opposite edges and located on the underside of the panels, where a second hook projection facing an upper side of the panel is provided on the free end of the second web.

13. Fastening system according to claim 11, wherein the second hook projection contacts the first web of the first panel when adjacent panels are joined, and a space is defined between the first hook projection and the second web.

14. Fastening system according to claim 11, wherein the holding surfaces of the hook projections engage in such a way to only be hooked together by means of elastic deformation of the hook elements.

15. Fastening system according to claim 14, wherein the holding surfaces of the hook projections are inclined, that the hook projections taper from a free end of each of the projections towards the webs, and that the holding surfaces of complementary hook projections at least partially contact one another when adjacent panels are connected along the second pair of opposite edges.

16. Fastening system according to claim 14, wherein a space is provided between a front side of the lower-side hook projection of the second panel and an inside surface of the first panel, and that a front side of the upper-side hook projection of the first panel contacts the second panel, at least in the region of the upper-side of the panel, when adjacent panels are connected along the second pair of opposite edges.

17. Fastening system according to claim 14, wherein at least one front side of one of the hook elements of the panels has a protruding snap element on a free end of said hook element, which engages an undercut recess of the other hook element of an adjacent panel when adjacent panels are connected along the second pair of opposite edges.

18. Fastening system according to claim 17, wherein the protruding snap element of the panel is designed as a ridge that extends over the entire length of one of said second pair of opposite edges, and that the undercut recess of the panel is designed as an elongated groove that receives the ridge when adjacent panels are connected along the second pair of opposite edges.

19. Fastening system according to claim 13, wherein the spaces existing when two panels are connected form glue pockets.

20. Fastening system according to claim 1, wherein the panels are made of a coated substrate material and the positive-fit profiles and holding profiles form an integral part of the edges of the panels.

21. Fastening system according to claim 1, wherein the panels are made of a material selected from the group consisting of MDF, HDF and particle board material.

22. Panel with a fastening system according to claim 1.

23. Fastening system according to claim 11, wherein the first hook projection contacts the second web of the second panel when adjacent panels are joined, and a space is defined between the second hook projection and the first web.

24. A fastening system for panels comprising:

holding profiles provided on at least a first pair of opposite first and second sides of a first panel, said holding profiles being complementary to one another so as to allow one of said sides of said first panel to be connected to an opposite side of a second panel of identical construction to the first panel, said holding profiles further comprising:

a first profile having a projection, said projection having an underside defining a convex surface and an upper side having a bevel at a free end thereof; and a second profile complementary to said first profile and having a recess defined on a lower edge thereof by a lower wall having a concave surface therein;

said first profile and said second profile each forming elements of an articulating joint which, when joined with a complementary profile of an adjacent panel of like construction with a top face of said adjacent panel lying in a common plane with a top face of said first panel, enable bidirectional rotation of said panels about a pivot axis that is parallel to said first pair of opposite sides of said panel.

25. The fastening system of claim 24, said first profile and said second profile being configured such that when a first profile of a first panel is joined to a complementary second profile of a second panel, said bevel on said projection defines an open space between said projection and a wall defining a portion of said recess in said second panel, said open space enabling rotation of adjacent, joined panels with respect to one another so as to cause said top faces to achieve an angle relative to one another of greater than 180°.

26. The fastening system of claim 24, said convex surface and said concave surface each forming a segment of a circle.

27. The fastening system of claim 26, wherein a center of the circle defined in part by said segment is located at a point on or below said upper side of said projection.

28. The fastening system of claim 24, said projection being positioned with respect to an edge of said top face of said first panel such that a point on said projection that is the greatest vertical distance from said top face lies within a vertical plane extending parallel to and immediately adjacent said edge of said top face.

29. The fastening system of claim 24, said lower wall of said recess on said second profile having a bevel at a free end thereof.

30. The fastening system of claim 29, said first profile and said second profile being configured such that when the first profile of said first panel is joined to a complementary second profile of a second panel, said bevel on said lower wall of said recess of said second profile defines an open space between said lower wall of said second panel and a portion of said first profile in said first panel, said open space enabling rotation of adjacent, joined panels with respect to one another so as to cause said top faces to achieve an angle relative to one another of greater than 180°.

31. The fastening system of claim 24, said lower wall of said second profile being configured for resilient deformation away from the top face of said panel.

32. The fastening system of claim 31, wherein said holding profiles are configured so as to not cause resilient deformation when said first profile of said first panel and a second profile of a second panel are fully engaged with one another.

33. The fastening system of claim 24, further comprising:

a second set of holding profiles provided on a second pair of opposite sides of said first panel, said second set of holding profiles being complementary to one another so as to allow one of said sides of said second pair of opposite sides of said first panel to be connected to an opposite side of said second pair of opposite sides of a second panel of identical construction to the first panel, said second set of profiles being configured for attachment to one another via a linear connecting movement.

34. The fastening system of claim 33, said second set of holding profiles each forming elements of a joint having generally rectangular tongue-and-groove cross-sections.

35. The fastening system of claim 33, said second set of holding profiles being of like configuration to said holding profiles on said first pair of opposite sides of said panel.

36. The fastening system of claim 24, wherein said holding profiles form an integral part of an edge on each of said opposite sides of said panel.

37. The fastening system of claim 24, said first profile and said second profile being configured to define open space therebetween after said first profile of said first panel has been joined to said second profile of a second panel, said fastening system further comprising a filler within said open space, said filler remaining flexible after curing of said filler.

38. The fastening system of claim 24, further comprising:

a second set of holding profiles provided on a second pair of opposite sides of said first panel, said second set of holding profiles further comprising a first hook element on a first one of said second pair of opposite sides and a second hook element on a second one of said second pair of opposite sides, said second hook element being complementary to said first hook element.

39. The fastening system of claim 38, each of said first and second hook elements further comprising a holding surface, each said holding surface being oriented such that when said second set of holding profiles of adjacent panels are engaged, said holding surfaces engage one another so as to prevent the creation of gaps between the top faces of adjacent short edges of adjacent panels.

40. The fastening system of claim 39, further comprising:

a first web extending outward from an upper side of said first one of said second pair of opposite sides in a direction generally perpendicular to said first one of said second pair of opposite sides, said first web having a free end, and said first web suspending said first hook from said free end of said first web in a downward orientation; and a second web extending outward from a bottom side of said second one of said second pair of opposite sides in a direction generally perpendicular to said second one of said second pair of opposite sides, said second web having a free end, and said second web supporting said second hook from said free end of said second web in an upward orientation.

41. The fastening system of claim 40, said second set of holding profiles being configured to define open space therebetween after said first profile of said second set of holding profiles has been joined to said second profile of said second set of holding profiles on an adjacent panel, said open space being defined between said first hook element on one of said panels and said second web on the other of said panels.

42. The fastening system of claim 41, said open spaces being configured to receive glue therein.

43. The fastening system of claim 40, said second set of holding profiles being configured to define open space therebetween after said first profile of said second set of holding profiles has been joined to said second profile of said second set of holding profiles on an adjacent panel, said open space being defined between said first web on one of said panels and said second hook element on the other of said panels.

44. The fastening system of claim 43, said open spaces being configured to receive glue therein.

45. The fastening system of claim 40, each said holding surface being inclined, and each said hook projection tapering from a free end thereof to the web to which said hook projection is attached.

46. The fastening system of claim 40, said first one of said second pair of opposite sides having an inner, non-horizontal surface below said first web, and said second set of holding profiles being configured to define open space therebetween after said first profile of said second set of holding profiles has been joined to said second profile of said second set of holding profiles on an adjacent panel, said open space being defined between an outer edge of said second hook element and said inner, non-horizontal surface of said first one of said second pair of opposite sides, and being further configured to cause at least a top point of said first hook element to contact said adjacent panel after said first profile of said second set of holding profiles has been joined to said second profile of said second set of holding profiles on said adjacent panel.

47. The fastening system of claim 38, said second set of holding profiles being configured so as to require elastic deformation of said hook elements in order to engage a first one of said second pair of opposite sides of said first panel with a second one of said second pair of opposite sides of a second panel.

48. The fastening system of claim 38, wherein at least one of said first and second hook elements further comprises a snap element protruding from a free end thereof, and the other of said first and second hook elements further comprises an undercut recess configured to engage said snap element.

49. The fastening system of claim 48, said snap element further comprising a ridge extending over an entire length of one of said opposite sides of said second pair of opposite sides of said first panel, and said undercut recess further comprising an elongated groove extending over an entire length of the other of said opposite sides of said second pair of opposite sides of said first panel, said elongated groove being configured to receive said ridge.

50. The fastening system of claim 24, said panel being formed of a coated substrate material having edges coinciding with said first pair of opposite sides of said panel, and said holding profiles are formed as an integral part of said edges.

51. The fastening system of claim 24, said panel being formed from materials selected from the group consisting of MDF, HDF, and particle board material.

52. A panel having the fastening system of claim 24.

53. A rectangular floor panel, comprising:

a joint projection edge provided on a first edge of the panel, complementary to and adapted to project into a joint recess edge of an adjacent panel of the same structure to form a common joint, the joint projection edges comprising a joint projection having a single convex curvature on a lower portion thereof;

a joint recess edge provided on a second edge of the panel opposite said first edges, complementary to and adapted to receive a joint projection of an adjacent panel of the same structure to form a common joint, the joint recess edge comprising a joint recess having a single concave curvature on a lower portion thereof;

said first and second edges being adapted to enable bidirectional rotation of adjacent, joined panels from a coplanar position;

a first hook element provided on a third edge of the panel, complementary to and adapted to engage a second hook element of an adjacent panel of the same structure to form a common joint; and a second hook element provided on a fourth edge of the panel, complementary to and adapted to engage a first hook element of an adjacent panel of the same structure to form a common joint.

54. The floor panel of claim 53, each of said first and second hook elements further comprising a holding surface, each said holding surface being oriented such that when said first hook element and said second hook element of adjacent panels are engaged with one another, said holding surfaces engage one another so as to prevent the creation of gaps between a top face of each of said adjacent panels at their adjacent third and fourth edges.

55. The floor panel of claim 54, further comprising:

a first web extending outward from an upper side of said third edge in a direction generally perpendicular to said third edge, said first web having a free end, and said first web suspending said first hook from said free end of said first web in a downward orientation; and a second web extending outward from a bottom side of said fourth edge in a direction generally perpendicular to said fourth edge, said second web having a free end, and said second web supporting said second hook from said free end of said second web in an upward orientation.

56. The floor panel of claim 55, said first hook and said second hook being configured to define open space therebetween after said first hook has been joined to a second hook of an adjacent panel, said open space being defined between said first hook element on one of said panels and said second web on the other of said panels.

57. The floor panel of claim 56, said open spaces being configured to receive glue therein.

58. The floor panel of claim 55, said first hook and said second hook being configured to define open space therebetween after said first hook has been joined to a second hook of an adjacent panel, said open space being defined between said first web on one of said panels and said second hook element on the other of said panels.

59. The floor panel of claim 58, said open spaces being configured to receive glue therein.

60. The floor panel of claim 55, each said holding surface being inclined, and each said hook projection tapering from a free end thereof to the web to which said hook projection is attached.

61. The floor panel of claim 55, said third edge having an inner, non-horizontal surface below said first web, and said first and second hook elements being configured to define open space therebetween after said third edge has been joined to a fourth edge of an adjacent panel, said open space being defined between an outer edge of said second hook element and said inner, non-horizontal surface of said third edge, and being further configured to cause at least a top point of said first hook element to contact said adjacent panel after said first hook element has been joined to a second hook element on said adjacent panel.

62. The floor panel of claim 53, said first and second hook elements being configured so as to require elastic deformation of said hook elements in order to engage said first hook element with said second hook element.

63. The floor panel of claim 53, wherein at least one of said first and second hook elements further comprises a snap element protruding from a free end thereof, and the other of said first and second hook elements further comprises an undercut recess configured to engage said snap element.

64. The floor panel of claim 63, said snap element further comprising a ridge extending over an entire length of one of said third and fourth edges, and said undercut recess further comprising an elongated groove extending over an entire length of the other of said third and fourth edges, said elongated groove being configured to receive said ridge.

65. A rectangular floor panel, comprising:

a first hook element provided on a first edge of the panel, complementary to and adapted to engage a second hook element of an adjacent panel of the same structure to form a common joint;

a second hook element provided on a second edge of the panel opposite said first edge, complementary to and adapted to engage a first hook element of an adjacent panel of the same structure to form a common joint; and complementary holding profiles on a third edge and a fourth edge of the panel, said complementary holding profiles being adapted to enable bidirectional rotation of adjacent, joined panels from a coplanar position;

each of said first and second hook elements further comprising a holding surface, each said holding surface being oriented such that when said first hook element and said second hook element of adjacent panels are engaged with one another, said holding surfaces engage one another so as to prevent the creation of gaps between a top face of each of said adjacent panels at their adjacent first and second edges.

66. The floor panel of claim 65, further comprising:

a first web extending outward from an upper side of said first edge in a direction generally perpendicular to said first edge, said first web having a free end, and said first web suspending said first hook from said free end of said first web in a downward orientation; and a second web extending outward from a bottom side of said second edge in a direction generally perpendicular to said second edge, said second web having a free end, and said second web supporting said second hook from said free end of said second web in an upward orientation.

67. The floor panel of claim 66, said first hook and said second hook being configured to define open space therebetween after said first hook has been joined to a second hook of an adjacent panel, said open space being defined between said first hook element on one of said panels and said second web on the other of said panels.

68. The floor panel of claim 67, said open spaces being configured to receive glue therein.

69. The floor panel of claim 66, said first hook and said second hook being configured to define open space therebetween after said first hook has been joined to a second hook of an adjacent panel, said open space being defined between said first web on one of said panels and said second hook element on the other of said panels.

70. The floor panel of claim 69, said open spaces being configured to receive glue therein.

71. The floor panel of claim 66, each said holding surface being inclined, and each said hook projection tapering from a free end thereof to the web to which said hook projection is attached.

72. The floor panel of claim 66, said first edge having an inner, non-horizontal surface below said first web, and said first and second hook elements being configured to define open space therebetween after said first edge has been joined to a second edge of an adjacent panel, said open space being defined between an outer edge of said second hook element and said inner, non-horizontal surface of said first edge, and being further configured to cause at least a top point of said first hook element to contact said adjacent panel after said first hook element has been joined to a second hook element on said adjacent panel.

73. The floor panel of claim 65, said first and second hook elements being configured so as to require elastic deformation of said hook elements in order to engage said first hook element with said second hook element.

74. The floor panel of claim 65, wherein at least one of said first and second hook elements further comprises a snap element protruding from a free end thereof, and the other of said first and second hook elements further comprises an undercut recess configured to engage said snap element.

75. The floor panel of claim 74, said snap element further comprising a ridge extending over an entire length of one of said first and second edges, and said undercut recess further comprising an elongated groove extending over an entire length of the other of said first and second edges, said elongated groove being configured to receive said ridge.

* * * * *